US005116095A

United States Patent [19]

Kotrla

[11] Patent Number: 5,116,095

[45] Date of Patent: May 26, 1992

[54] APPARATUS FOR LIFTING HEAVY EQUIPMENT

[75] Inventor: John E. Kotrla, Harris County, Tex.

[73] Assignee: Baroid Technology, Inc., Houston, Tex.

[21] Appl. No.: 642,198

[22] Filed: Jan. 16, 1991

[51] Int. Cl.[5] ..... B66C 1/62; E21B 25/00

[52] U.S. Cl. ..... 294/94; 294/86.25

[58] Field of Search ..... 294/93, 94, 95, 97, 294/86.24, 86.25, 89; 279/2 R

[56] References Cited

U.S. PATENT DOCUMENTS

| | | | |
|---|---|---|---|
| 812,214 | 2/1906 | Law et al. | 294/89 X |
| 3,307,871 | 3/1967 | Russell et al. | 294/97 X |
| 4,050,731 | 9/1977 | Coone et al. | 294/93 X |
| 4,277,875 | 7/1981 | Worrell | 294/94 X |
| 4,361,353 | 11/1982 | Vinson | 294/86.24 X |
| 4,666,200 | 5/1987 | Walker et al. | 294/95 X |
| 4,784,398 | 11/1988 | Lund | 294/93 X |

FOREIGN PATENT DOCUMENTS

| | | | |
|---|---|---|---|
| 1088969 | 10/1967 | United Kingdom | 294/86.25 |

OTHER PUBLICATIONS

Set of drawings and operating instructions for Hughes Running Tool, Jul. 1986.

*Primary Examiner*—Margaret A. Focarino
*Assistant Examiner*—Dean J. Kramer
*Attorney, Agent, or Firm*—Browning, Bushman, Anderson & Brookhart

[57] ABSTRACT

Running tool apparatus for lifting heavy equipment such as diverters and other devices utilizing a drilling rig drawworks. The running tool has a slotted discs and pins mechanism to cause engaging dogs to engage and disengage the heavy equipment when rotational force is applied. A keeper assembly mounted at the top of the running tool keys into an impression at the top of the heavy equipment to secure the outer body of the running tool with respect to the heavy equipment. The inner body is sealed with respect to the outer body and the tool is shaped so that the heavy equipment can be pressure tested with the running tool engaged in the bore of the heavy equipment.

5 Claims, 6 Drawing Sheets

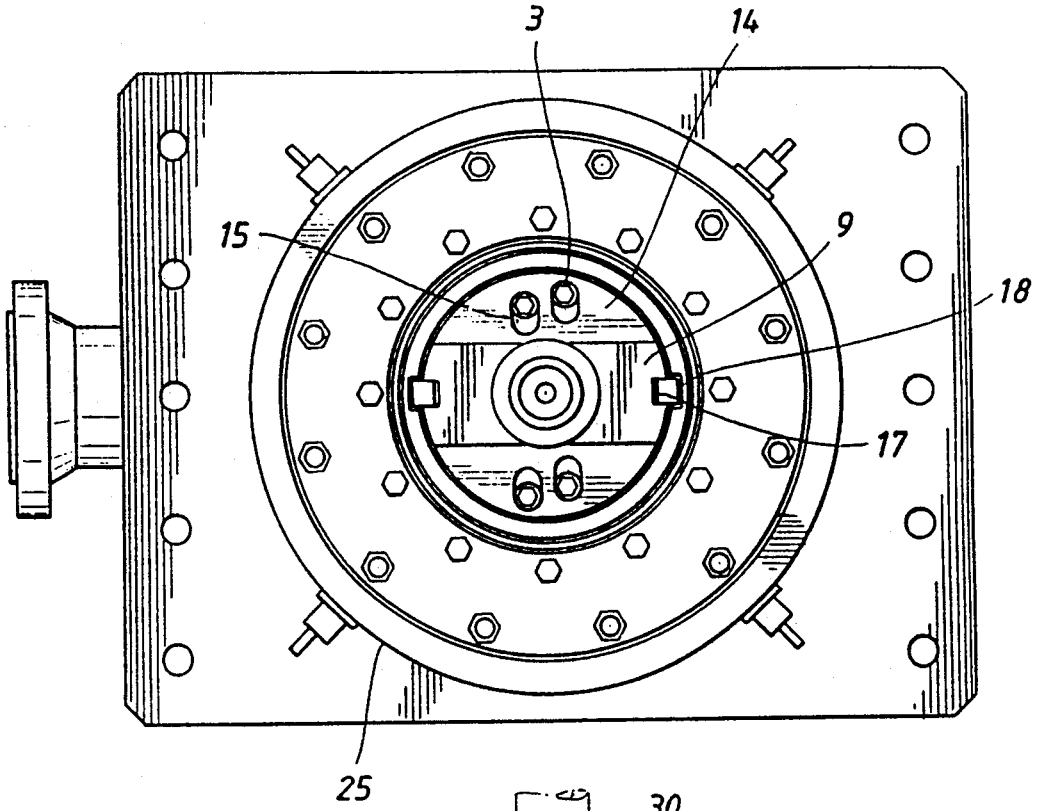
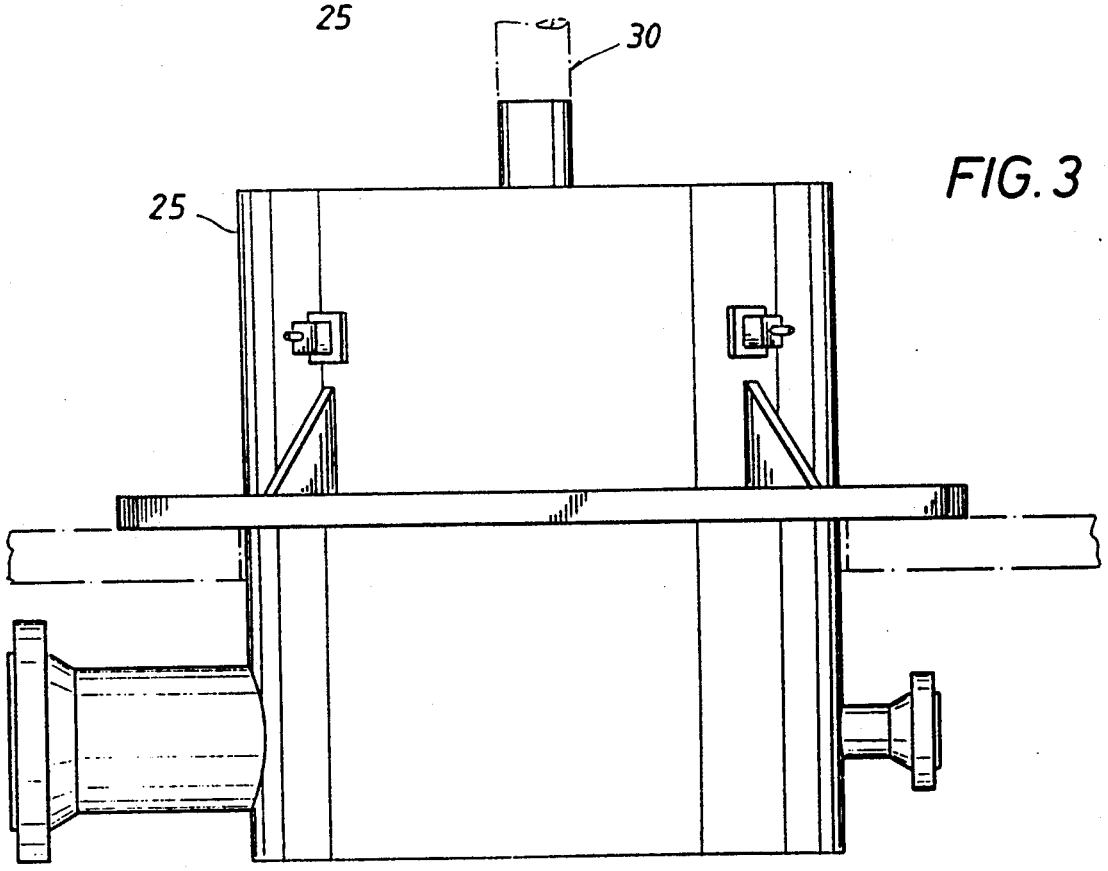
FIG. 3

FIG. 8
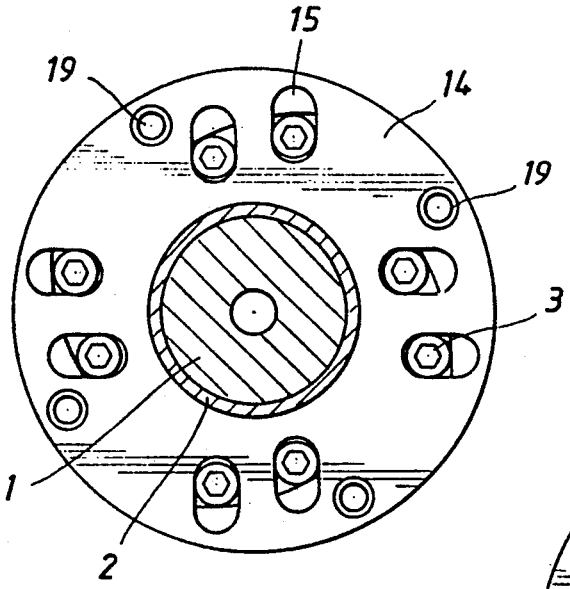
FIG. 9
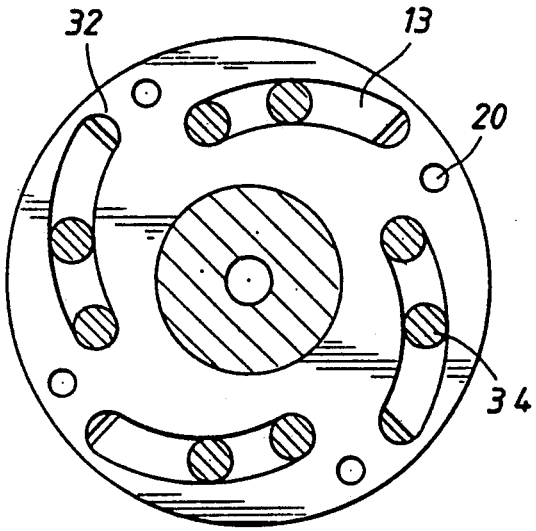
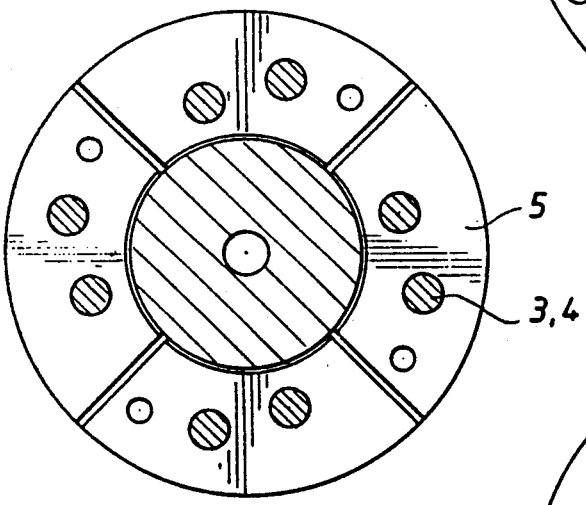
FIG. 10
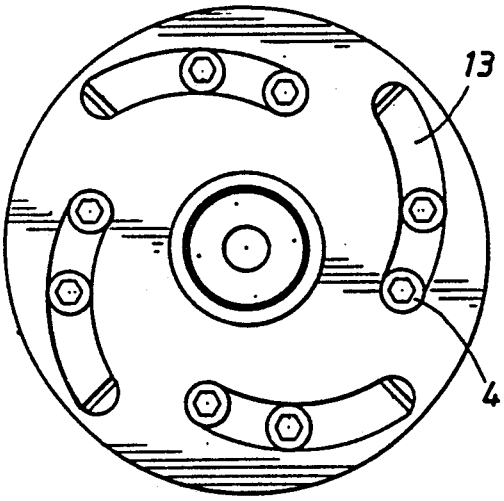
FIG. 11

FIG.12
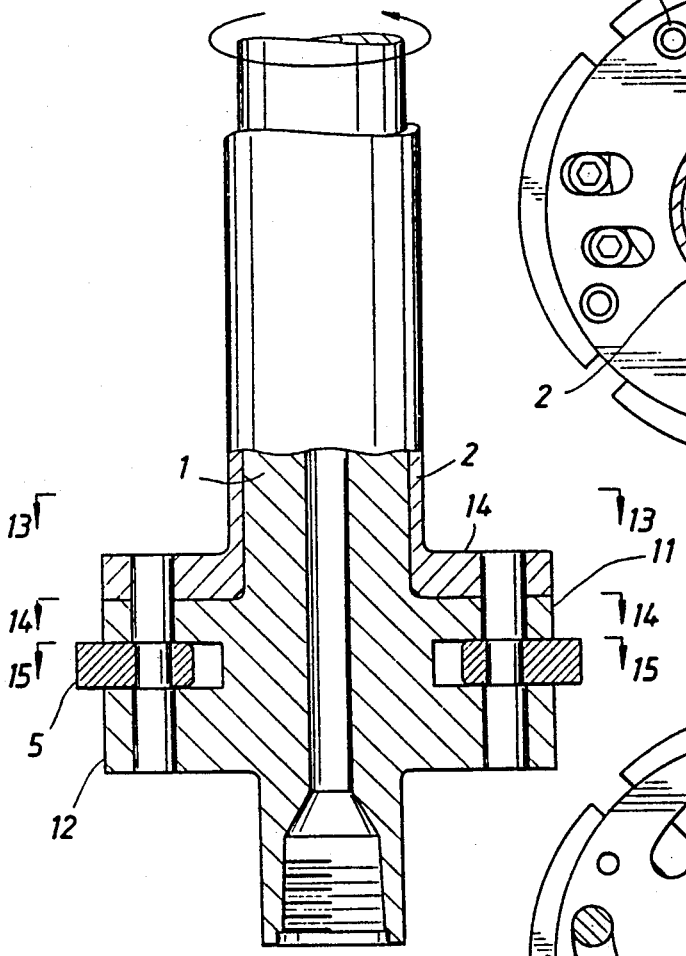
FIG.13
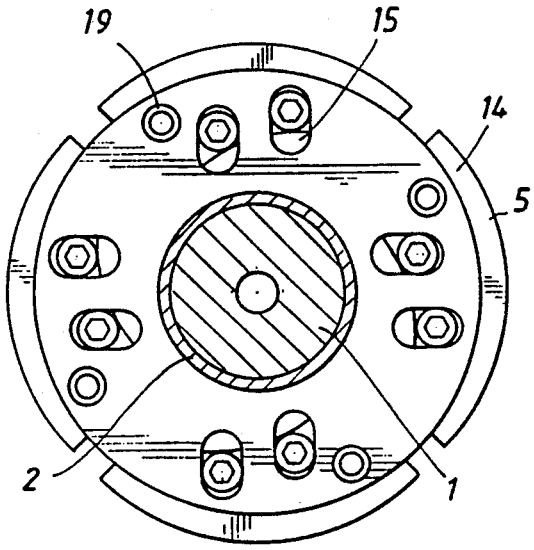
FIG.14
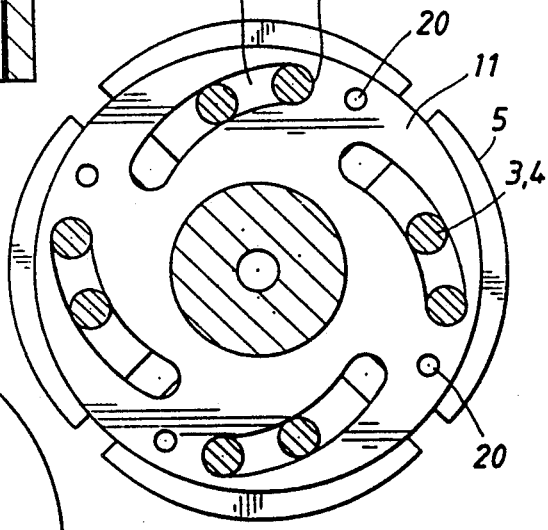
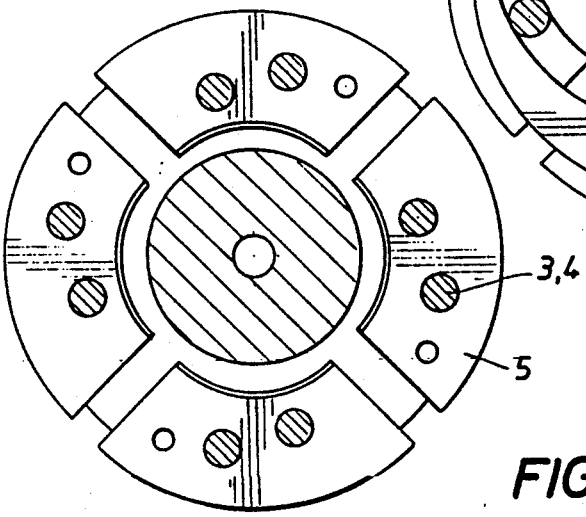
FIG.15

FIG. 16
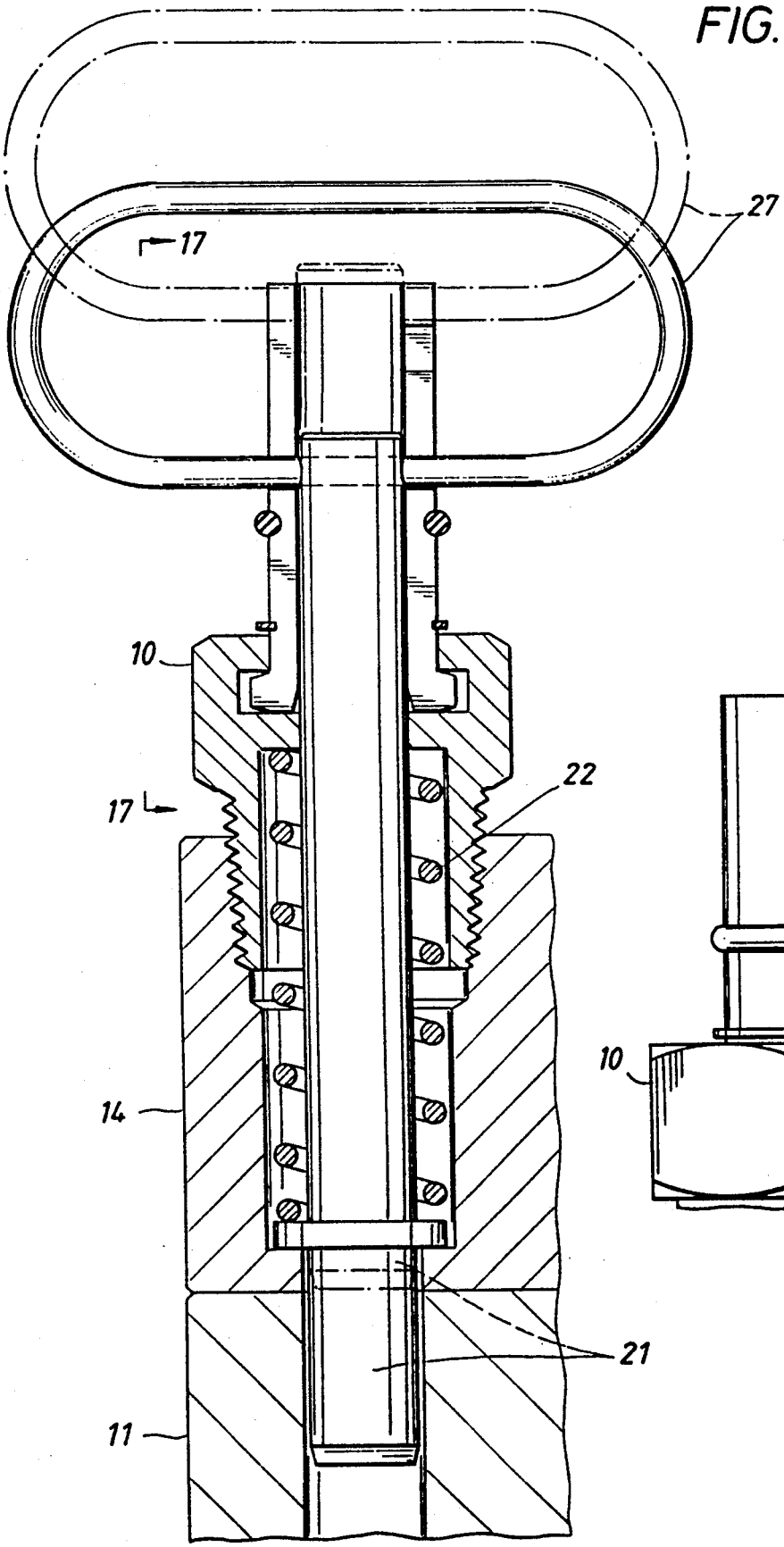
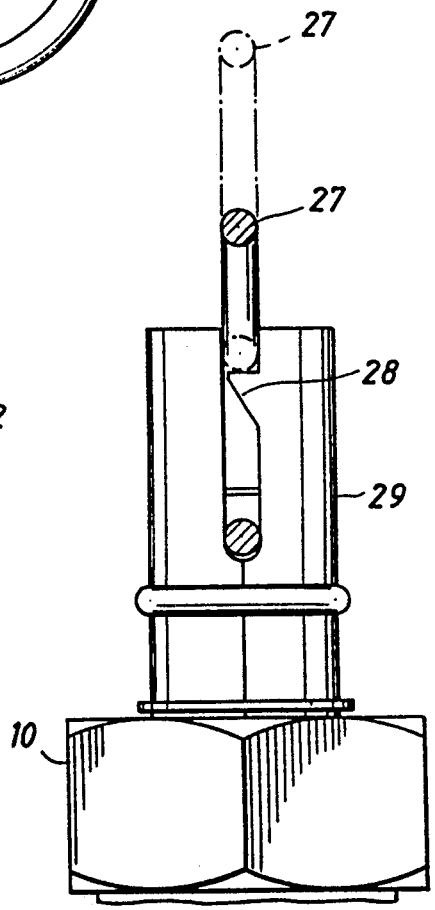
FIG. 17

APPARATUS FOR LIFTING HEAVY EQUIPMENT

BACKGROUND OF THE INVENTION

1. Field of the Invention

The present invention generally relates to lifting heavy equipment and, more particularly, is concerned with apparatus for engaging heavy equipment including blow out preventors and diverters used on drilling rigs in such a way that the drawworks of a drilling rig can be utilized in the lifting process.

2. Description of the Prior Art

The development of the present invention comes in response to the difficulties encountered when lifting diverters—devices which often weigh somewhere in the range of 50,000 lbs. Diverters are pressure control devices used frequently on offshore floating platforms. The modern versions of the diverter may best be described as a low pressure blow out preventer (B.O.P.).

Floating platforms have their main B.O.P. stacks located on the sea bed. Telescoping risers reach from the B.O.P.'s on the seabed to the floating platform. The diverter is mounted on the top of the telescoping risers.

Due to the heavy weight of the diverter, it is necessary to use the blocks of the rig to pick it up. Therefore, a crossover tool which connects the diverter to the blocks is required. In the trade, this type of tool is referred to as a diverter handling tool or a diverter running tool.

The running tool must be capable of engaging the diverter in such a way that the diverter will not be damaged and so that personnel will be protected from accidents. In some conceivable situations, the running tool may be called upon to lift the entire assembly of diverter, risers, and B.O.P. stack. The weight of this assembly can run up to 750,000 lbs. Therefore, in designing a running tool and including safety factors, the pulling strength of the running tool may be in the 2,000,000 lb. range.

The presently available diverter tools have a number of shortcomings.

A design problem arises from the massiveness of the running tools because it is difficult to design an effective engaging mechanism that is also straightforward for the rig crew to operate. Representative instructions for engaging the presently available running tool to the diverter include a right and left turn of the inner with respect to the outer body of the tool interspersed with a requirement to lift up on the tool. In the course of these instructions, it becomes difficult to maintain vertical alignment of the dogs, or engaging elements, to the groove in the diverter bore in which they must engage.

To overcome such problems, presently available running tools employ dogs that have engaging surfaces angled to about 45 degrees. In this way, the dogs can pull the tool into correct alignment as engagement force is applied if the tool is roughly at the correct position. However, this solution creates other problems.

When vertical lifting forces are applied to 45 degree angled engaging surfaces, an inwardly directed horizontal or radial resultant force is produced that is equivalent to the vertical lifting force. This radial force pushes inwardly on the engaging surfaces and creates a tendency for the tool to disengage. Also the radial force causes wear on the inner body of the tool that is not readily detectible and that may result in a loose fit of the running tool with the diverter.

The prior art tools have no positive means for retracting the dogs. Instead, the inner body is moved so that a cavity exists into which the dogs should retract. When the tool is lifted, the same radial force that biases the dogs to disengage as discussed above, also forces the dogs to retract into the cavity. This procedure creates the possibility of sticking and jerking when attempting to disengage the dogs. Also, if the dogs are not completely retracted, it's possible that jerking and dragging may damage some of the sealing elements of the diverter as the tool is removed from the bore of the diverter.

With regard to the sealing elements, the presently available tool does not allow for pressure testing of the diverter. So once the diverter is installed, the running tool must be removed prior to pressure testing the diverter. If the diverter does not seal and the diverter must be removed for repair, then the running tool must be reinstalled. This wastes time. As well, some diverters require up to four hours before the sealing elements become relaxed enough so that the running tool can be reinstalled. Considering the premium that is placed on offshore rig time, this could be a costly shortcoming.

Another problem that may develop with these tools is that if the tool is improperly aligned or if there is a failure in the engaging mechanism, and a large engaging force is applied, the tool may be jammed into a binding, or cocked, position that will take some time to correct.

Other means of lifting the diverters have been considered. For instance, rather than attempting to engage the running tool in the bore of the diverter below the sealing mechanisms, it's been suggested that a housing be mounted on top of the diverter. A more simple engaging means, such as a J - slot locking device could be used inside such a housing. However, companies which utilize the diverters feel that using the space above the diverter for a housing is not feasible. The simple J - slot locking device is also not feasible for use within the bore of the diverter below the sealing mechanisms because grooves would have to go through the sealing area of the diverter.

Consequently, a need exists for improvements in lifting techniques of heavy equipment such as diverters which will result in running tools that are easier and safer for the rig crew to operate.

OBJECTS OF THE INVENTION

The present invention provides a running tool apparatus designed to satisfy the aforementioned needs. This invention embodies a running tool with an engaging mechanism that requires only a single rotational movement to engage the dogs. By reversing the rotational movement, the dogs can be positively disengaged. Problems with sticking disengagement due to partially unretracted dogs are eliminated.

More particularly, the engaging mechanism employs a system of slotted discs to positively drive pins fixed to the dogs through the slots. The pin and slot mechanism used in this invention is more complicated than the mechanisms used in the prior art but it is also much easier for the rig crew to operate. In this way, the present invention enhances rig crew safety and also decreases lost rig time.

As a rule, greater complexity in a mechanism this massive is generally associated with decreased reliability. However, in this case, the greater complexity yields the unexpected result of increased reliability as compared to the prior art. One reason for this is that the majority of moving parts are readily visible for inspection and lubrication.

This invention uses the upper horizontal surfaces of the dogs to engage the heavy equipment. Problems from a resultant radial force created when the lifting force is applied to non-horizontal lifting surface are therefore eliminated. Reasonably expected wear or indentations made on any lifting surfaces will generally have little or no effect on how tightly the surfaces grip. Also, there is no biasing force acting on the dogs to cause them to have a tendency towards disengagement.

The present invention allows for an easily visible weak link that will prevent application of the engaging force if the engaging mechanism malfunctions for some reason. On the other hand, the present invention permits a large disengaging force to be applied should it become difficult to disengage the tool.

A keeper assembly on the top of the running tool allows for quick, positive, visually verifiable alignment of the running tool with the diverter. The keeper assembly also secures the outer body relative to the heavy equipment so that rotational force can be applied to the inner body without disturbing the alignment.

Furthermore, the present invention allows pressure testing of the diverter while the running tool is engaged in the diverter. The outer body and inner body employ a fluid-tight seal to prevent a potential pressure leakage path. Also, the outer body is shaped so that the sealing elements of the heavy equipment can seal around it.

Although the present invention is designed to be used with diverters, it can be used to lift other heavy equipment such as B.O.P. stacks or any other equipment that needs to be lifted from the inside.

BRIEF DESCRIPTION OF THE DRAWINGS

FIG. 2 is a top view according to FIG. 1, showing the running tool keyed into the top of the diverter.

FIG. 3 is a side view of a diverter with a running tool engaged therein.

FIG. 8 is a top view, partly in section, taken along the lines 8—8 of FIG. 4 showing the first disc in the disengaged position.

FIG. 9 is a top view, partly in section, taken along the lines 9—9 of FIG. 4 showing the second disc in the disengaged position.

FIG. 10 is a top view, partly in section, taken along the lines 10—10 of FIG. 4 showing the dogs in the disengaged position.

FIG. 11 is a bottom view, taken along the lines 11—11 of FIG. 4 showing the third disc in the disengaged position.

FIG. 12 is an elevational view, partly in section, of a running tool according to the present invention in the engaged position.

FIG. 13 is a top view, partly in section, taken along the lines 13—13 of FIG. 12 showing the first disc in the engaged position.

FIG. 14 is a top view, partly in section, taken along the lines 14—14 of FIG. 12 showing the second disc in the engaged position.

FIG. 15 is a top view, partly in section, taken along the lines 15—15 of FIG. 12 showing the dogs in the engaged position.

FIG. 16 is an elevational view, partly in section, showing the locking assembly of the present invention.

FIG. 17 is an elevational view, partly in section, taken along the lines 17—17 of FIG. 16 showing the locking assembly.

DESCRIPTION OF THE PREFERRED EMBODIMENT

Figure 1:
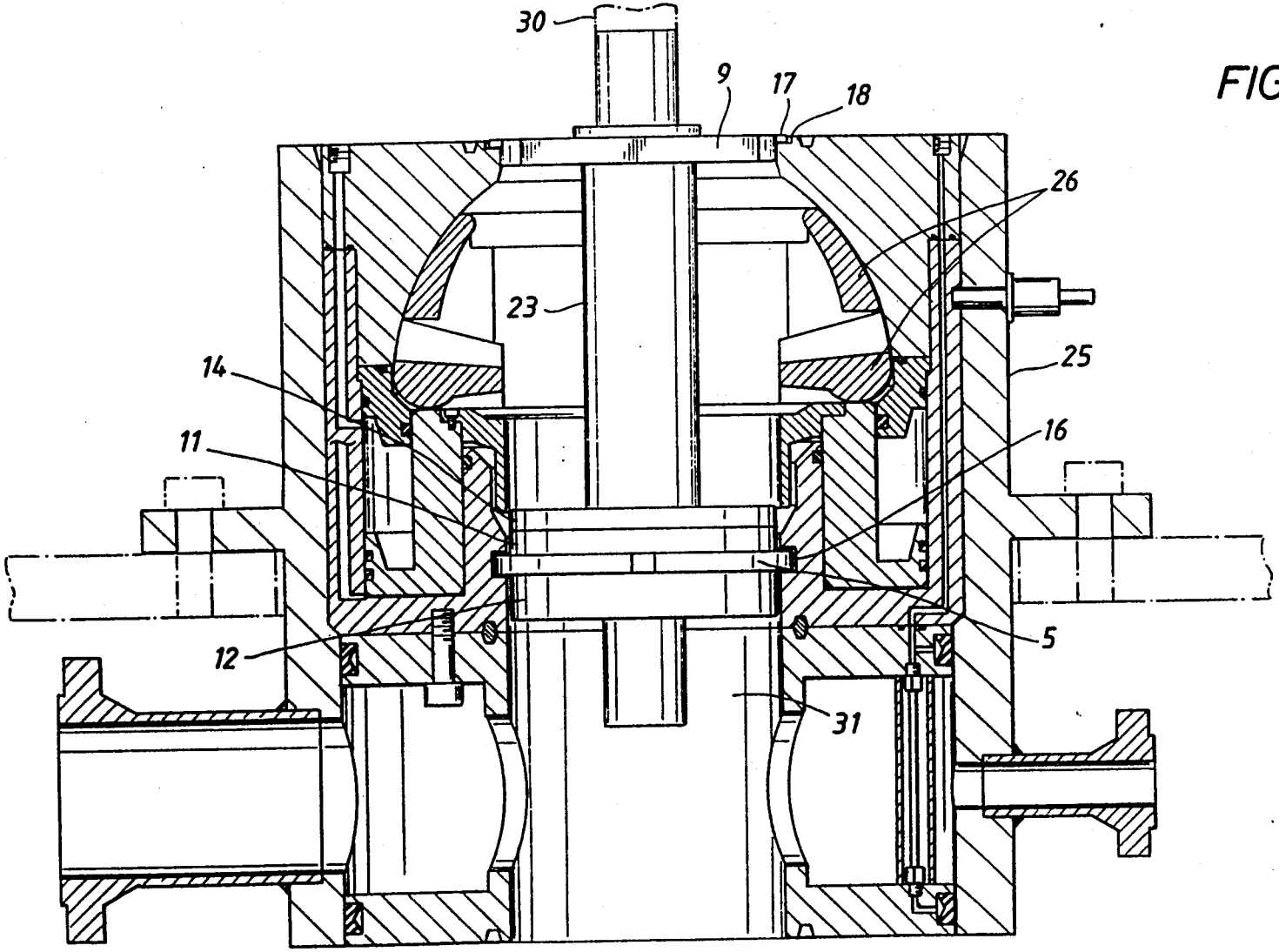
FIG. 1 is an elevational view, partly in section, of a running tool according to the present invention engaged within a diverter.
Figure 4:
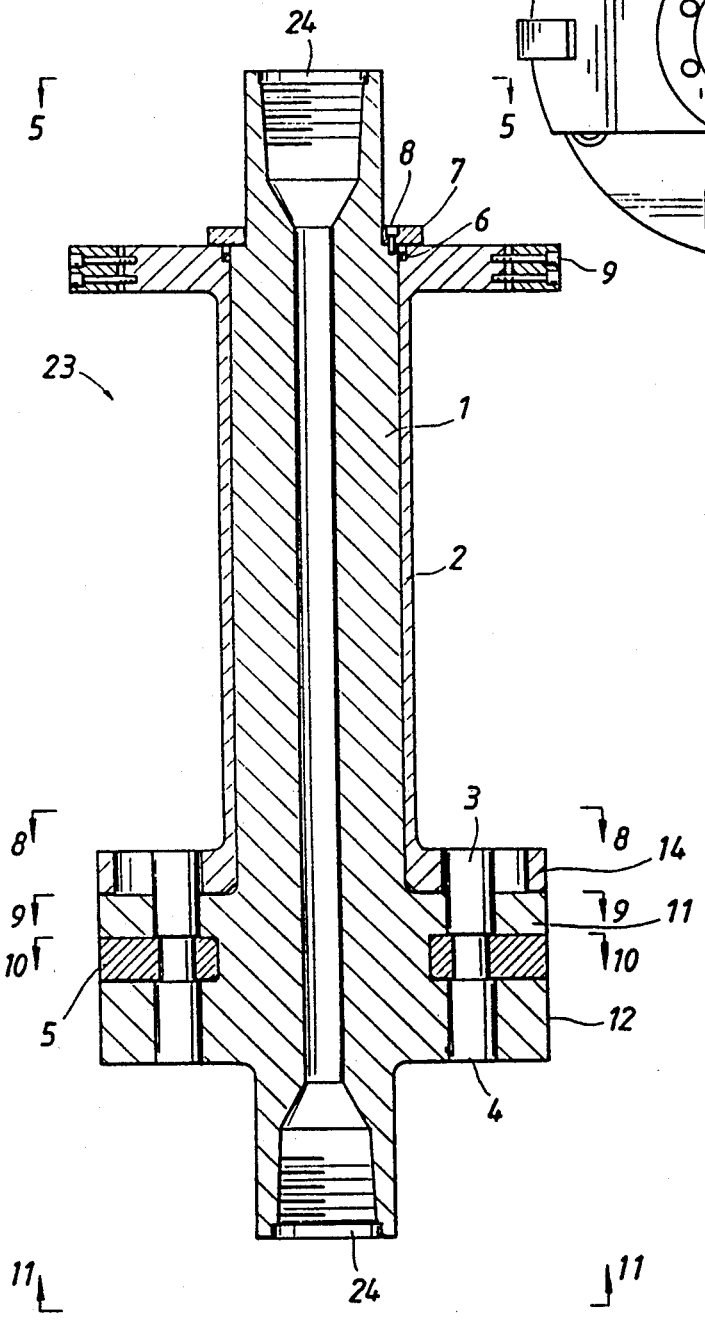
FIG. 4 is an elevational view, in section, of the running tool of the present invention.
Figure 7:
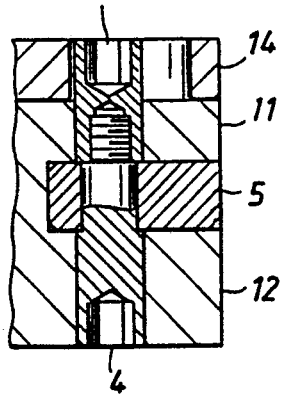
FIG. 7 is an enlarged view, in section, showing the male and female portions of an engaging pin.

Referring now to the drawings, and more particularly, to FIG. 4, there is schematically shown a diverter running tool apparatus, generally designated 23, for lifting diverters utilizing the drilling rig drawworks (not shown). The running tool 23 generally includes an inner body 1 and a surrounding outer body 2. Engaging male 4 and female 3 pins extend through first 14, second and third 12 discs found as radially outwardly extending flanges from outer body 2 and inner body 1 respectively. More detail concerning the engaging male 4 and female 3 pins can be seen in FIG. 7. At this time, the preferred embodiment includes constructing the inner body 1 and the second 11 and third 12 discs out of one piece of material. This procedure uses more material as the inner body 1 is machined from a surplusage of material but, at this time, is less expensive than welding the discs 11,12 onto the rest of the inner body 1. However, it is also feasible that the discs 11,12 could be welded onto the inner body 1. Attachment means 24, in the form of a threaded box or pin, is built into the top of the inner body 1 so that a drill pipe 30 (FIG. 3) can be connected to the running tool 23 and the entire assembly of the running tool 23 and diverter FIG. 1, can then be picked up by the rig drawworks. An attachment means 24, also in the form of a threaded box or pin, is also present at the bottom of the running tool 23 and can be used as desired for rig purposes.

Also seen in FIG. 4 are the engagement dogs 5. In FIG. 4, the engagement dogs 5 are shown in the retracted position. FIG. 12 shows the engagement dogs 5 in the extended position. The engagement dogs 5 engage the engaging groove 16 in the diverter 25 (FIG. 1.) so that the diverter 25 can be lifted.

Figure 5:
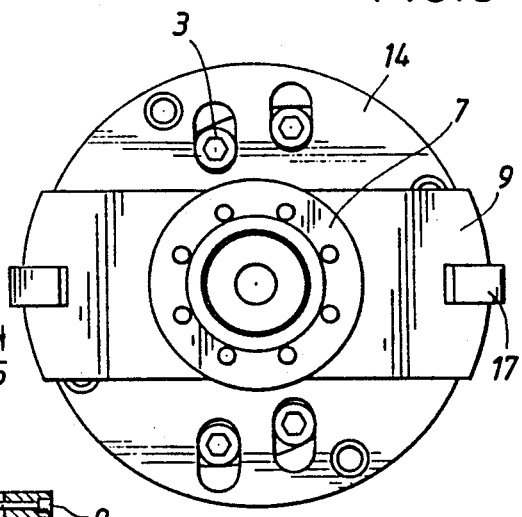
FIG. 5 is a top view taken along the lines 5—5 of FIG. 4, showing the keeper assembly.

FIG. 5 illustrates the keeper assembly 9 which is fixed to the outer body 2. Mounted on the keeper assembly 9 are tabs 17. The keeper assembly 9 slips into an impression 18 (FIG. 2.) shaped to match the keeper assembly 9 in the top of the diverter 25. Once the keeper assembly 9 is placed into the impression 18, the outer body 2 is secured from downward, sideways, or rotational movement relative to the diverter 25. This is because the impression 18 secures the keeper assembly 9 which is fixed to outer body 2 as described above. As well, the dogs 5 will now be properly aligned opposite the engaging groove 16 in the diverter 25. This arrangement of keeper assembly 9 and impression 18 on top of the diverter 25 also forms a readily visible means by which the rig crew can verify proper alignment of the running tool 23 with the diverter 25.

Once the running tool 23 is properly aligned, the preferred embodiment provides for engaging the dogs 5 into the engaging groove 16 of the diverter 25 by rotating the inner body counterclockwise 33 degrees with respect to the outer body 2. I practice, the drill pipe 30 which was attached to the attachment means 24 will be rotated counterclockwise looking down from the top of the drill pipe. Since the drill pipe 30 is being rotated counterclockwise, a breakable connection is formed at the attachment means 24 and the drill pipe. If the engaging mechanism is jammed, the drill pipe 30 will loosen rather than permit excess force to be applied. On the other hand, when disengaging the dogs 5, a large force can be applied because the rotation direction will be clockwise and the drill pipe connection will tighten rather than loosen.

Figure 6:
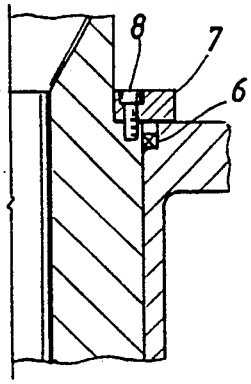
FIG. 6 is an enlarged view showing the details of the seal between inner and outer bodies.

FIG. 4 and, in more detail, FIG. 6, show a seal retainer 7 and a seal with modular bearing back-up ring 6 mounted onto the inner body 1 with cap screws 8. With this assembly, a fluid-tight seal is formed between the inner body 1 and the outer body 2. The outer body 2 is shaped so that the sealing elements 26 of the diverter 25 can make a fluid-tight seal around the outer body 2. In this way, the running tool 23 can be pressure tested with the running tool 23 engaged in the diverter 25. If the diverter 25 fails to pressure test properly, the diverter 25 can be removed from the risers as necessary without having to reinstall the running tool 23. In the event a customer prefers to operate the engagement/disengagement in reverse rotation as that described above, it would not materially affect the other features of the invention and could be easily incorporated.

FIG. 4 as well as FIG. 8 through FIG. 15 illustrate various views of the running tool 23 engaging mechanisms. FIG. 4 through FIG. 11 show the running tool 23 in the disengaged position. FIG. 12 through FIG. 15. show the running tool 23 in the engaged position.

A description of the structure of the engaging mechanism follows after which follows a general description of the operation of the running tool 23.

Disposed within the second 11 and third 12 discs (FIG. 9 and FIG. 11) are four identical, symmetrically located, outwardly directed arcuate slots 13. It's necessary to have two such discs with arcuate slots 13 because when the engagement pins 3,4 are pushed through the slots 13 they would become cocked or tilted if there were only one disc with arched slots 13. In the first disc 14, eight straight slots 15 can be seen arranged in four pairs (FIG. 8 and FIG. 13). The straight slots 15 in each pair are essentially parallel.

Two engagement pins 3,4 are fixed into each of the four dogs 5 (FIG. 10 and FIG. 15). The engagement pins 3,4 extend through three slots each. As the second 11 and third 12 discs are rotated with respect to the first disc 14, the engagement pins 3,4 are constrained to move either outward or inward, depending on the direction of rotation, within the first disc 14 straight slots 15. Since the engagement pins 3,4 are fixed into the engagement dogs 5, this action also causes the engagement dogs 5 to either engage or disengage. Although conceivably a gear arrangement could be used to drive the engagement dogs, the pins are generally sturdier than the individual teeth of a gear.

A spring loaded locking pin assembly 10 (FIG. 16) mounts on the first disc 14 within a hole 19 (FIG. 8). Actually four holes 19 are formed in the preferred embodiment but only one hole 19 is used at a time. The other holes 19 are spares in case the assembly 10 should be broken off and a new hole 19 is needed. Prior to engagement of the engagement dogs 5, the locking assembly 10 is placed in a cocked position so that the locking pin 21 is spring 22 loaded. Just before the counterclockwise rotation of the middle and lower 12 discs causes the engagement pins 3,4 to reach the end of travel in the arcuate slots 13, the hole 19 in the first disc 14 will align with a hole 20 in the second disc 11 (FIG. 8 and FIG. 9) and the locking pin 21 will be forced to go through both holes by spring 22 thus locking the third 12 and second 11 discs in the same position as the first disc 14. In other words, the holes 19 and 20 line up just before the engagement pins 3,4 reach the stopping edge 32 in the arcuate slots 13. This prevents the application of a sideways force to the pins 3,4 which would occur if the engagement pins 3,4 were allowed to hit the stopping edge 32 in the arcuate slots 13. In this way, the running tool 23 is locked in the engaged position. Prior to disengaging the running tool 23, the handle 27 is pulled to put the locking assembly 10 into the uncocked position. Normally a rope is attached to the handle 27 prior to putting the running tool 23 into the diverter. The rig crew then pulls on this rope to disengage this assembly 10.

FIG. 16 illustrates the preferred embodiment locking assembly 10. This one assembly has a spring loaded catch 28 that holds the mechanism in the uncocked position after the handle 27 is pulled up. The catch 28 can be released when the split body 29 separates to release the catch 28. Once the catch 28 is released, then the assembly 10 is cocked and the locking pin 21 is under tension by the spring 22.

A description of the running tool 23 operation follows to facilitate an overall understanding of the running tool 23. Assuming it is desired to remove the diverter 25 from the risers (not shown), a drill pipe 30, often in the form of a pup joint or short joint for easier handling, is screwed into the top of the running tool 23 which will probably be located on the rig floor. The cat line of the rig is attached to the joint of pipe & the running tool is picked up. Using the rig tongs and rotary table, the rig crew can tighten the drill pipe 30 into the attachment means 24 of the running tool 23. The drill pipe 30 can be attached to the drawworks during this time.

The rig crew should now cock the locking assembly 10 so that the locking pin 21 is spring loaded and resting against the second disc 11. The running tool 23 is then lowered into the bore 31 of the diverter 25. The running tool 23 goes into the diverter 25 bore 31 as far as the keeper assembly 9. The keeper assembly 9 has an outside diameter larger than the bore 31 so the running tool 23 cannot go deeper. The keeper assembly 9 and the tabs 17 on the keeper assembly 9 are guided into the impression 18 in the top of the diverter 25. The keeper assembly 9, to which the outer body 2 is attached, now prevents further downwards, sideways or rotational movement of the outer body 2 because the keeper assembly 9 is secured inside the impression 18. Furthermore, the keeper assembly is attached to the outer body 2 at a certain distance from the dogs 5 so that the dogs 5 are now directly opposite the groove 16 in the bore 31 of the diverter 25.

The rig crew can rotate the drill pipe 30 counterclockwise to engage the engagement dogs 5. The outer body 2 is secured by the keeper assembly 9 as just explained. The drill pipe 30 is attached to the inner body 1. The second 11 and third 12 discs, also being fixed to the inner body 1, should rotate counterclockwise along with the drill pipe 30. The arcuate slots 13 in the second 11 and third 12 discs should also move because they are impressed in the second 11 and third 12 discs which move when the inner body 1 moves. The engaging pins 3,4 , which are in the arcuate slots 13, are prevented from moving counterclockwise with the second 11 and third discs 12 because they also go through the first disc 14 which has straight slots 15 and because the first disc 14 is secured from movement by the keeper assembly 9. Therefore, as the arcuate slots 13 move, the engaging pins 3,4 are cammed radially outward following the path of the straight slots 15 in the first disc 14. Since the engaging pins 3,4 are fixed to the dogs 5, the dogs 5 also move radially outward and into the groove 16 of the diverter 25. The rotation of the drill pipe 30 should continue until the locking pin 21 pops into hole 20 in the second disc 11 (see FIG. 9). At this point, hole 19 and hole 20 are aligned with each other, the engagement dogs 5 are properly located in the groove 16 in the bore 31 of the diverter 25 so that the running tool 23 is locked into the engaged position. The diverter 25 can be lifted as desired.

It is thought that the running tool apparatus of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A running tool used in lifting heavy equipment with a lifting means, said running tool comprising:

a. an inner body;

b. an outer body surrounding said inner body;

c. an engaging means wherein said engaging means to engage heavy equipment includes, a plurality of dogs slidably mounted within said inner body to physically engage said heavy equipment.

a first disc fixed onto said outer body, a second and a third disc fixed onto said inner body so that said second and third discs are fixed with respect to each other and with respect to said inner body, said second disc being located between said first and third discs, said dogs being slidably attached between said second and third disc, said dogs having an upper surface, said upper surface being the engaging surface when said engagement dogs are extended into a groove in said heavy equipment, said groove being shaped to adapt to said engagement dogs, engaging pins fixed to said dogs and slidably mounted in slots located in said first, second, and third discs so that rotation in a first direction of said second and third discs relative to said first disc constrains said engaging pins and hence said dogs to move outward relative to said running tool, said engaging pins being mounted so that rotation in a second opposite direction constrains said engaging pins and hence said engagement dogs to move inward relative to said running tool;

d. a keeper assembly for securing said outer body from further motion relative to said heavy equipment such that said engaging means is properly aligned with said heavy equipment; and e. a locking assembly for locking said running tool in an engaged position during operation.

2. The running tool as recited in claim 1, wherein said engaging means to engage said heavy equipment includes:

(a) said second and third discs having four identical outwardly directed arcuate slots located symmetrically on each said second and third disc so that said arcuate slots on each of said second and third disc are vertically aligned to each other to form four pairs of said arcuate slots;

(b) said first disc having eight straight slots arranged in pairs, each said pair having two said straight slots which are essentially parallel, said straight slots being essentially radially directed;

(c) four of said dogs for engaging said heavy equipment, said dogs being arrayed in a ring when said dogs are in the disengaged position;

(d) four sets of two of said engaging pins, one set of two of said engaging pins fixed into each of said four dogs so that as said engaging pins move said dogs also move, each of said engaging pins being slidably mounted in said slots of said three discs, one set of two of said engaging pins being positioned in each of said four pairs of said arcuate slots formed in said second and third discs, each set of two of said engaging pins also being positioned in a corresponding pair of said straight slots in said first disc with one of said engaging pins to each said straight slot in said first disc, each of said engaging pins being held in the vertical position by the sides of said three slots in which each of said engaging pins is positioned so that said engaging pins cannot tilt and thereby tilt said dog; and (e) said engaging pins being positioned so that as said second and third discs rotate in said first direction relative to said first disc, said engaging pins and hence said dogs are constrained to move outward relative to said running tool, said dogs engaging said groove in said heavy equipment, said upper surfaces of said dogs engaging the corresponding surfaces of said grooves when lifting forces are applied to said running tool, said engaging pins also positioned so that as said second and third discs are rotated in the second opposite direction with respect to said first disc, said engaging pins and hence said dogs are constrained to move inward relative to said running tool, thus disengaging said dogs from said groove.

3. The running tool as recited in claim 2, wherein said engaging means to engage said heavy equipment includes:

(a) said first disc having a first hole for said locking assembly;

(b) said second disc having a second hole for said locking assembly;

(c) said arcuate slots having a stopping edge;

(d) said first and second holes lining up with each other just before said engaging pins reach said stopping edge of said arcuate slots as said second and third discs rotate in said first direction relative to said first disc to engage said dogs; and (e) said locking assembly forcing a locking pin through said first and second holes to lock said running tool in an engaged position.

4. A running tool used in heavy equipment with a lifting means, said running tool comprising:

a. an inner body;

b. an outer body surrounding said inner body;

c. an engaging means to engage said heavy equipment, said engaging means engaging said heavy equipment when said outer body is rotated in a first direction relative to said inner body, said engaging means disengaging said heavy equipment when said outer body is rotated in a second opposite direction relative to said inner body;

d. a keeper assembly for securing said outer body from further motion relative to said heavy equipment such that said engaging means is properly aligned with said heavy equipment; and e. a locking assembly for locking said running tool in an engaged position during operation;

f. an attachment means built into said inner body for attaching drill pipe to said running tool so that said running tool may be picked up by the drawworks of a drilling rig;

g. said attachment means to said drill pipe forming a breakable connection when said drill pipe is rotated in said first direction relative to said outer body so that said breakable connection will loosen if said engaging means is jammed; and h. said attachment means to said drill pipe forming a locking connection when said drill pipe is rotated in said second opposite direction relative to said outer body.

5. A running tool used in lifting heavy equipment with a lifting means, said running tool comprising:

a. an inner body;

b. an outer body surrounding said inner body;

c. an engaging means including, a first disc fixed on said outer body, said disc having eight straight slots arranged in pairs, each of said straight slots in each said pair being essentially parallel, said straight slots being radially directed, a second and third disc fixed onto said inner body and fixed with respect to each other, said second disc located between said first and third discs, said second and third discs having four identical outwardly directed arcuate slots located symmetrically on each said disc so that said arcuate slots of each said disc are vertically aligned to each other to form four pairs of said arcuate slots, four dogs for engaging said heavy equipment, said dogs being slidably attached between said second and third discs, said dogs forming a ring with each other when said dogs are in the disengaged position, four sets of two engaging pins per set, one said set fixed in each said dog so that as said engaging pins move said dogs also move, each said set of two engaging pins being slidably mounted in said slots of all three of said discs so that one said set of two said engaging pins is positioned in each said pair of slots formed in said second and third discs, said engaging pins also being positioned in one of said corresponding pairs of said straight slots in said first disc with one said engaging pin to each said straight slot, each said engaging pin being held in position by the sides of the three said slots in which each said engaging pin is positioned so that said engaging pins cannot tilt and thereby tilt said dog, said engaging pins being positioned so that as said second and third discs rotate in a first direction relative to said first disc, said engaging pins and hence said dogs are constrained to move outward relative to said running tool, said dogs engaging a groove in the bore of said heavy equipment, said upper surfaces of said engagement dogs engaging the corresponding surfaces of said groove when lifting forces are applied to said running tool, said engaging pins positioned so that as said second and third discs are rotated in a second opposite direction with respect to said first disc, said engaging pins and hence said dogs are constrained to move inward relative to said running tool;

e. a keeper assembly built onto said outer body, said keeper assembly having tabs mounted thereon, said keeper assembly having an outside diameter larger than any other portion of said running tool, said keeper assembly having an outside diameter larger than the inside diameter of said bore in said heavy equipment;

said keeper assembly slidably fitting into an impression in the top of said heavy equipment, said impression being shaped to match the form of said keeper assembly so that once said keeper assembly is placed into said impression said outer body is generally secured from further downward, sideways, or rotational movement relative to said heavy equipment and said running tool is aligned with said heavy equipment so that said dogs are directly opposite said grooves in said bore of said heavy equipment;

f. a locking assembly, said locking assembly being mounted on said first disc and capable of forcing a locking pin through a hole in said first disc when said hole is aligned with a similar size hole in said second disc, said two holes being positioned so they will be aligned when said dogs engage said heavy equipment, said locking pin holding said running tool in the engaged position during operation, g. a seal retainer with modular bearing back-up ring built onto said keeper assembly to make a fluid tight seal between said outer body and said inner body, said outer body being shaped in a way that said heavy equipment can seal around said outer body; and h. an attachment means built into said inner body for attaching drill pipe to said running tool so that said running tool may be picked up by the drawworks of a drilling rig.

* * * * *